US005256275A

United States Patent [19]

Brasch

[11] Patent Number: 5,256,275

[45] Date of Patent: Oct. 26, 1993

[54] ELECTROPLATED GOLD-COPPER-SILVER ALLOYS

[75] Inventor: William R. Brasch, Nesconset, N.Y.

[73] Assignee: LeaRonal, Inc., Freeport, N.Y.

[21] Appl. No.: 869,244

[22] Filed: Apr. 15, 1992

[51] Int. Cl.[5] ..... C25D 3/62

[52] U.S. Cl. ..... 205/247; 205/248

[58] Field of Search ..... 205/247, 248, 305, 306, 205/311, 313, 104

[56] References Cited

U.S. PATENT DOCUMENTS

| | | | |
|---|---|---|---|
| 4,465,564 | 8/1984 | Fletcher et al. | 205/104 |
| 4,869,971 | 9/1989 | Nee et al. | 205/104 |
| 5,006,208 | 4/1991 | Kuhn et al. | 204/44 |

FOREIGN PATENT DOCUMENTS

| | | |
|---|---|---|
| 62-164890 | 7/1987 | Japan . |
| 529843 | 12/1972 | Switzerland . |

OTHER PUBLICATIONS

Chemical Abstract 78: 66285p Mar. 12, 1973.

*Primary Examiner*—John Niebling

*Assistant Examiner*—Brian M. Bolam

*Attorney, Agent, or Firm*—Pennie & Edmonds

[57] ABSTRACT

A solution for electroplating gold-copper-silver alloys. The solution comprises gold, copper and silver, each in the form of a cyanide complex. The solution further comprises a divalent sulfur compound capable of brightening and leveling the electroplated deposit of the gold-copper-silver alloy. Optionally, a source of cyanide ions such as a free alkali cyanide, is included in the solution. In addition, additives such as surface active agents, buffers and/or conductivity salts may also be included to impart a particular feature or characteristic to the solution. The invention additionally comprises a process for electroplating up to about 20 microns of a gold-copper-silver alloy upon a substrate utilizing these novel solutions. The alloy is deposited upon a substrate which is immersed in the solution, by electroplating at a current density of between about 1 and 15 ASF, a pH of between about 8–11 at a temperature of between about 100°–170° F. for a time sufficient to obtain the desired thickness. Improved brightness results are obtained with the process of the invention by manipulating the electroplating current.

35 Claims, No Drawings

ELECTROPLATED GOLD-COPPER-SILVER ALLOYS

TECHNICAL FIELD

The invention relates to the electrodeposition of gold-copper-silver alloys and more particularly to the application of such deposited alloys upon jewelry components for decorative use.

BACKGROUND OF THE INVENTION

Gold alloys have been deposited for many years onto watchcases, watchbands, eyeglass frames, writing instruments, costume jewelry, and the like. The karat of these deposits usually ranges from 12 to 18, the deposit thicknesses range from 2 to 20 microns, and the deposit colors are pale yellow to pink.

For many years, the most often utilized electroplated gold alloy for these applications has been gold-copper-cadmium. Since cadmium is such a o poisonous metal, however, the electroplating industry has been searching for a substitute having a reduced level of toxicity. In addition to being non-toxic, the gold alloy deposits produced with such a cadmium substitute must have the following required physical characteristics:

1. The deposits must have the correct color, as required. Usually, these colors are the Swiss standard "1-5N", which range from specific pale yellow to pink gold alloys, with the "2N" yellow grade being preferred.
2. The deposits must be bright so that no further polishing is required after plating. This degree of brightness must be maintained even for thick deposits as high as 20 microns.
3. The plating bath must produce deposits that exhibit levelling such that tiny imperfections in the basis metal are smoothed out or covered.
4. The karat of the deposits should be as required. These karats generally range from about 12 to 18, or about 50-75% gold.
5. All deposits must be reasonably ductile and capable of passing the required ductility tests, even with thicknesses as high as 20 microns.
6. The deposits should be corrosion resistant and capable of passing the required corrosion tests.

A number of attempts have been made in the past as described below to deposit gold-copper-silver alloys as a substitute for the conventional gold-copper-cadmium alloys in a manner which can readily meet all of the above requirements.

U.S. Pat. No. 5,006,208 to Kuhn et al. discloses a gold-copper-silver alloy deposit from a cyanide solution using a selenocyanate brightener in an amount of 0.1 to 1 mg/liter. However, whereas deposits of 2-3 microns of gold-copper-silver alloys deposited as described by the reference were determined to provide satisfactory performance, thicker deposits of 10-20 microns, were found not to be sufficiently bright to enable commercial use of this process. In addition, the leveling characteristics of these processes were also insufficient. Moreover, the '208 patent additionally describes, e.g., at col. 1, lines 43-62, a variety of other prior art techniques for depositing gold-copper-silver alloys which were likewise found not to meet the requirements set forth above.

Japanese Patent Publication No. 62-164890, published Jul. 21, 1987 also discloses the deposition of gold-copper-silver alloys from cyanide solutions. In these plating solutions potassium citrate and a non-ionic surfactant were included as additives. This process was also found to perform unsatisfactorily when thicker deposits were attempted in that such deposits lacked brightness and were insufficiently leveled.

None of the disclosures discussed above have resulted in a commercially acceptable plating bath. That is, they have not been shown to be capable of producing deposits with the required characteristics set forth above. Thus, the relatively undesirable gold-copper-cadmium alloys are still in wide commercial use as of the present date since, until the present invention, there has been no commercially acceptable substitute.

SUMMARY OF THE INVENTION

The present invention relates to a solution for electroplating gold-copper-silver alloys. The solution contains gold, copper and silver, each in the form of a cyanide complex, as well as a divalent sulfur compound selected for its capability for brightening and leveling the electroplated deposit of the gold-copper-silver alloy. The solution may also contain excess cyanide ions provided by the addition of a free alkali cyanide to the solution. Additives such as surface active agents, buffers and/or conductivity salts may also optionally be added to impart a particular feature or characteristic to the solution.

A further embodiment of the invention relates to a process for electroplating up to about 20 or more microns of a gold-copper-silver alloy upon a substrate with the use of the electroplating solutions described above. The alloy deposit is formed upon a substrate which is immersed in the solution by electroplating at a current density of between about 1 and 15 ASF, a pH of between about 8 and 11 and at a temperature of between about 100°-170° F. for a time sufficient to obtain a deposit of the desired thickness. In a preferred embodiment of the process, the current is manipulated to achieve the desired brightness and leveling. The use of this technique, in combination with the presence of the divalent sulfur compound within the electroplating solution, results in the formation of deposits having superior brightness and leveling in contrast to such deposits produced with the use of a continuous current.

DETAILED DESCRIPTION OF THE PREFERRED EMBODIMENTS

The present invention relates to gold-copper-silver alloys deposited from a formulation that is new and different from those described in the prior art. For the first time, with the use of the bath of the invention, gold-copper-silver deposits can now be produced that meet all of the requirements (i.e., nos. 1-6) set forth above.

The gold, copper and silver are all present in the plating bath of the invention in the form of their cyanide complex. The bath of the invention thus comprises from about 1 to about 12 gm/l. of gold as a gold cyanide complex, from about 5 to about 50 gm/l. of copper as a copper cyanide complex and from about 0.01 to about 1 gm/l. of silver as a silver cyanide complex. The bath also contains from about 0.001 to about 1 gm/l. of a divalent sulfur compound, described below in greater detail, to enhance the brightness and facilitate leveling of the deposit. Optionally, the bath may further include a free alkali cyanide to serve as a source of cyanide ions and a surface active agent. The pH of the solution is adjusted to between about 8-11 and the temperature of the bath is maintained at between about 100°-170° F.

In a preferred embodiment of the invention, the bath comprises from 3 to 8 gm/l. of gold metal as potassium gold cyanide, from 15 to 30 gm/l. of copper metal as potassium copper cyanide and from 0.05 to 0.25 gm/l. of silver metal as potassium silver cyanide. In addition, the bath further comprises from 3 to 6 gm/l. of free potassium cyanide, i.e., which, as noted above, provides cyanide ions to the bath, from 0.075 to 0.25 gm/l. of a divalent sulfur compound, and from 0.1 to 4 ml/l. of a surface active agent. The preferred pH ranges between 8.5 and 9.5 and the preferred temperature of the bath is between 130° and 150° F.

Although the plating bath described above is formed solely with potassium-based compounds, it is also possible to form any or all of the cyanide based salts and other salts or compounds used in the bath with other alkali compounds, such as sodium, ammonium, or a mixture of two or more of such alkali compounds, including potassium. Potassium-based compounds are preferred, however, and are thus used as non-limiting examples in the discussion which follows.

In the bath of the present invention, as noted above, the gold, copper and silver are present in the form of soluble cyanide complexes. The gold is preferably added as $KAu(CN)_2$. Copper may be added as $K_2Cu(CN)_3$ or as CuCN or $Cu(OH)_2$ or any copper compound which dissolves in situ by complexing with free potassium cyanide to form the copper cyanide complex. The silver is preferably added as $KAg(CN)_2$, but it can also be added as AgCN or $AgNO_3$, or as AgCl or any silver compound which also dissolve in situ by complexing with the free potassium cyanide to form the silver cyanide complex. The amount of free potassium cyanide is preferably controlled by adding potassium cyanide as needed. Conversely, the concentration of this material may be reduced by the addition of CuCN or $Cu(OH)_2$ or any other copper compound capable of reducing free potassium cyanide.

The pH of the bath is controlled by adding either potassium hydroxide or potassium carbonate in order to raise the pH and by adding any compatible acid or its acid salt to reduce the pH. Suitable acids for this purpose include, but are not limited to, sulfuric acid, phosphoric acid, tartaric acid and acetic acid.

Divalent sulfur compounds are added to the bath to achieve brightness and leveling. Without these additives, the deposits produced by the plating bath of the invention are dull, i.e., lacking in luster and brightness (see, e.g., Example 3). The compounds chosen for use with the present invention must be soluble in the bath solution while retaining a high degree of stability therein.

The divalent sulfur compounds most suitable for use in the present invention are those containing a thiocarbonyl group (i.e., >C=S) such as, for example, thiourea, thiobarbituric acid and imidazolidinethione. Other suitable divalent sulfur compounds include: (1) those having a mercapto group (i.e. —SH), e.g., thiomalic acid, (2) those with a ≡S=S group, e.g., sodium thiosulfate and (3) those containing groups such as —S—CN or —N=C=S, e.g., sodium thiocyanate and sodium isothiocyanate. In all cases, however, the additive must contain at least one divalent sulfur atom. The minimum quantity of the divalent sulfur compound to be used is that needed to produce the desired brightness. About 0.001 to 1 gm/l. is suitable for this purpose.

Further, it is important to note that not all divalent sulfur compounds are suitable for use in the baths of the present invention. This is because some of these compounds are not soluble or stable in the bath while others will cause precipitation of some of the ingredients. Examples of such unsuitable divalent sulfur compounds include sodium sulfide and sodium diethyldithiocarbamate.

A simple test, readily capable of use by one of ordinary skill in the art, is set forth below for determining whether a particular divalent sulfur compound may be utilized as an additive in the baths of the present invention. This process comprises preparing one of the preferred plating baths as set forth in Examples 3-9 herein, whereupon the divalent sulfur compound in question is added and an object is plated. The results thus obtained indicate the suitability of the compound tested for meeting the requirements (i.e., nos. 1-6) discussed above in the Background of the Invention.

Buffers and conductivity salts may also optionally be included in the baths of the invention, if required, in amounts ranging between about 1 to about 100 gm/l. Preferred buffers and conductivity salts include, but are not limited to, borates, phosphates, carbonates or bicarbonates, citrates, acetates or similar salts.

Additionally, if desired, surface active, i.e., "wetting" agents may also be added to the baths of the invention to prevent pitting and to improve the brightness of the deposits. A number of wetting agents based on fatty compounds such as amine oxides, betaines, alkoxylates and phosphates are suitable for use with the invention. The most preferred wetting agents are the ethoxylated fatty acid phosphates and fatty amine oxides.

The current density used in the process of the invention can range between about 1 to 15 ASF with 4-6 ASF being preferred. The plating time depends upon the deposit thickness required and the current density of plating, as well as upon the cathode efficiency.

It has been determined that improved results are obtained by manipulating the electrical current applied to the bath of the invention, in combination with the inclusion of one or more divalent sulfur compounds as an additive as described above.

Current manipulation can be used to further enhance brightness and leveling. Current manipulation can be in the form of interrupted current, periodic reverse, pulse plating, pulse reverse, or combinations thereof. In particular, improved results have been obtained with the use of the interrupted current technique using repeated cycles ranging from 1:1, i.e., one second with the current turned on followed by one second with the current turned off, to 7:1, i.e., seven seconds with the current turned on followed by one second with the current turned off. Particularly advantageous results have been obtained using a 5:1 interrupted current cycle, i.e., where the current is repeatedly turned on for five seconds and then off for o one second. A simple plating test performed by those skilled in the art can determine which form of current manipulation and which cycle will best lead to improvements in brightness and leveling.

EXAMPLES

The following non-limiting Examples are provided solely for the purpose of illustration and are not to be construed as limiting the invention in any manner.

EXAMPLE I

A plating bath of the following composition was prepared:

| | |
|---|---|
| 43 gm/l. | KCN |
| 28.1 gm/l. | CuCN |
| 7.5 gm/l. | $KAu(CN)_2$ |
| 0.3 gm/l. | $KAg(CN)_2$ |
| 0.1 gm/l. | $CH_4N_2S$ (Thiourea) |
| 2 ml/l. | wetting agent |

The materials set forth above were dissolved in deionized water in the order listed. The pH of the solution was then adjusted to 9 with a 10% solution of phosphoric acid. The bath temperature was set at 140° F. (i.e., 60° C.) and agitation was supplied by motorized circular cathode movement and solution stirring.

Brass and stainless steel watch cases were plated in the bath described above at five (5) ASF (amps per square foot), i.e., 0.5 ASD (amps per square decimeter), with direct current interrupted at a rate of five (5) seconds on and one (1) second off for 37.5 minutes.

The deposit thus produced was very bright, pale yellow in color and free of any stress cracking. The karat was 17 was about 10 microns.

EXAMPLE II

The bath of Example I was prepared and the plating process was repeated in the same manner as in Example I, however, without the current interruption described above.

The resultant plated deposit was bright, although not as bright as in Example I. This demonstrates that, by interrupting the current, e.g., in the manner indicated in Example I, the brightness of the deposit is enhanced.

EXAMPLES III-IX

A stock solution was prepared, containing:

| | |
|---|---|
| 43 gm/l. | KCN |
| 28.1 gm/l. | CuCN |
| 7.5 gm/l. | $KAu(CN)_2$ |
| 0.3 gm/l. | $KAg(CN)_2$ |
| 2 ml/l. | wetting agent |

as in Example I, minus the brightening additive, i.e., thiourea.

EXAMPLE III

A one (1) liter sample of the stock solution produced as described above without any brightening additive was tested in the manner indicated in Examples I and II. The resultant deposit appeared hazy and dull, lacking the luster and brightness noted in Examples I and II. The appearance of the deposit thus obtained was unacceptable under the current industry standards. This Example demonstrates that, in the absence of a brightening additive, the current interruption technique described in Example I does not provide enhanced brightness to the deposit.

EXAMPLES IV-IX

In these Examples, different brightness additives were tested with the stock solution described above. Each additive was separately tested in one (1) liter of stock solution.

Brass and stainless steel watch cases as typically used in industry were plated using these solutions at 5 ASF (i.e., 0.5 ASD) and examined for brightness. The results thus obtained are set forth in the table provided below. As shown by the information provided by the table, those compounds containing sulfur in the divalent state are the most effective for use with the present invention.

TABLE

| Example | Brightening Additive and Amount (gm/l.) | Current Interruption | Deposit Appearance |
|---|---|---|---|
| 4 | Potassium Thiocyanate - 0.13 gm/l. | No | Bright |
| 4a | Potassium Thiocyanate - 0.13 gm/l. | Yes | Bright |
| 5 | Sodium Thiosulfate - 0.11 gm/l. | Yes | Fairly Bright |
| 6 | Thiomalic Acid - 0.20 gm/l. | Yes | Bright |
| 7 | Imidazolidinethione - 0.14 gm/l. | Yes | Very Bright |
| 8 | Sodium Sulfite - 0.17 gm/l. | Yes | Hazy |
| 9 | Thiobarbituric Acid - 0.19 gm/l. | Yes | Very Bright |

While it is apparent that the invention herein disclosed is well calculated to fulfill the objects above stated, it will be appreciated that numerous modifications and embodiments may be devised by those skilled in the art and it is intended that the appended claims cover all such modifications and embodiments as fall within the true spirit and scope of the present invention.

What is claimed is:

1. A solution for electroplating a gold-copper-silver alloy which comprises:

a soluble gold compound present as a gold cyanide complex in the solution;

a soluble copper compound present as a copper cyanide complex in the solution;

a soluble silver compound present as a silver cyanide complex in the solution in an amount of at least about 0.1 gm/l; and a solution soluble divalent sulfur compound of thiourea, imidazolidine-thione or thiobarbituric acid in an amount of at least about 0.075 gm/l to brighten alloys deposited by said solution during electroplating;

said solution having a pH of between about 8 and 11.

2. The solution of claim 1 wherein the concentration of gold ranges between about 1-12 gm/l. as gold metal.

3. The solution of claim 1 wherein the concentration of copper ranges between about 5-50 gm/l. as copper metal.

4. The solution of claim 1 wherein the concentration of silver ranges between about 01.-1 gm/l. as silver metal, and the solution is substantially free of cadmium.

5. The solution of claim 1 which further comprises a source of cyanide ions.

6. The solution of claim 5 wherein said source of cyanide ions is a free alkali cyanide.

7. The solution of claim 6 wherein said cyanide is potassium cyanide.

8. The solution of claim 6 wherein said alkali cyanide is sodium cyanide, ammonium cyanide or mixtures thereof.

9. The solution of claim 1 wherein said divalent sulfur compound is present in a concentration of between about 0.075-1 gm/l.

10. The solution of claim 1 which further comprises from about 1-100 gm/l. of a buffer material or conductivity salt.

11. The solution of claim 10 wherein said buffer material or conductivity salt is a borate, phosphate, carbonate, bicarbonate, citrate, acetate, or mixtures thereof.

12. The solution of claim 1 which further comprises at least one surface active agent in a concentration of up to about 10 ml/l.

13. The solution of claim 12 where said surface active agent is based on fatty compounds of amine oxide, betaine, alkoxylate or phosphate.

14. The solution of claim 13 wherein said surface active agent is an ethoxylated fatty acid phosphate.

15. The solution of claim 1 wherein said gold cyanide complex is $KAu(CN)_2$, said copper cyanide complex is $K_2CU(CN)_3$ and said silver cyanide complex is $KAg(CN)_2$.

16. A solution for electroplating a gold-copper-silver alloy consisting essentially of:

a soluble gold compound present as a gold cyanide complex in the solution and being present at a concentration of between about 1-12 gm/l as gold metal;

a soluble copper compound present as a copper cyanide complex in the solution and being present at a concentration of between about 5-50 gm/l as copper metal;

a soluble silver compound present as a silver cyanide complex in the solution and being present at a concentration of between about 0.1-1 gm/l as silver metal;

a solution soluble divalent sulfur compound, said divalent sulfur compound present at a concentration of between about 0.075-1 gm/l in said solution for brightening alloys deposited by said solution; and at least one surface active agent present in said solution, said solution having a pH of between about 8 and 11.

17. The solution of claim 16 which further comprises an alkali cyanide compound as a source of cyanide ions for the solution.

18. The solution of claim 17 wherein said divalent sulfur compound includes a >C=S, —SH, =S=S, —S—CN or —N=C=S group.

19. The solution of claim 18 wherein said divalent sulfur compound is thiourea, imidazolidinethione, or thiobarbituric acid.

20. The solution of claim 19 which further comprises from about 1-100 gm/l. of a buffer material or conductivity salt.

21. A process for electroplating gold-copper-silver alloys which comprises:

formulating the solution of claim 1 or 18;

immersing a substrate at least partially into the solution; and electroplating a gold-copper-silver alloy upon the substrate at a pH of between about 8 and 11, a current density of between about 1 to 15 ASF and at a temperature of between about 100° and 170° F. for a sufficient time to deposit a sufficient thickness of the alloy.

22. The process of claim 21 wherein the electroplating step includes manipulating the current to improve brightness and leveling of the deposit.

23. A process for electroplating gold-copper-silver alloys which comprises:

formulating a solution having a pH of between 8 and 11 and comprising a soluble gold compound present as a gold cyanide complex, a soluble copper compound present as a copper cyanide complex, a soluble silver compound present as a silver cyanide complex in an amount of at least about .1 gm/l, and a solution soluble divalent sulfur compound in an amount of at least about 0.075 gm/l;

immersing a substrate at least partially into the solution; and electroplating a gold-copper-silver alloy upon the substrate at a current density of between about 1 to 15 ASF and at a temperature of between about 100° and 170° F. for a sufficient time with a current manipulating step which includes switching current on and off at predetermined intervals to deposit a sufficient thickness of a desired gold alloy.

24. The process of claim 23 wherein the current manipulating step comprises switching said current on for a time at least as long as said current is switched off.

25. The process of claim 24 wherein the current manipulating step comprises switching said current on for from about one to about four times the time said current is switched off.

26. The process of claim 23 wherein the current manipulating step comprises selecting an interval of between about 1 and 7 seconds with the current turned on, followed by one second with the current turned off.

27. The process of claim 26 wherein the current manipulating step comprises selecting intervals of about five seconds with the current turned on, followed by one second with the current turned off.

28. The process of claim 23 which further comprises agitating the solution or moving the work while electroplating to obtain optimum electroplating results.

29. The process of claim 23 which further comprises adding a free alkali cyanide to said solution to provide a source of free cyanide ions thereto.

30. The process of claim 29 which further comprises adding a copper compound to said solution which is capable of dissolving in situ and forming a complex with said free alkali cyanide to form said copper cyanide complex.

31. The process of claim 29 which further comprises adding a silver compound to said solution which is capable of dissolving in situ and forming a complex with said free alkali cyanide to form said silver cyanide complex.

32. The process of claim 23 which further comprises controlling the pH of said solution to the desired range.

33. The process of claim 23 which further comprises adding a surface active agent to said solution prior to immersing the substrate therein.

34. The process of claim 23 wherein the temperature of said solution is maintained between about 130° and 150° F.

35. The process of claim 23 wherein the current density is maintained at between 4 and 6 ASF.

* * * * *